US010850419B2

(12) United States Patent
Svetlik et al.

(10) Patent No.: US 10,850,419 B2
(45) Date of Patent: Dec. 1, 2020

(54) METHOD FOR OPERATING A SLICING MACHINE, AND SLICING MACHINE FOR SPACED STORAGE OF SLICES OF PRODUCT

(71) Applicant: Bizerba SE & Co. KG, Balingen (DE)

(72) Inventors: Carsten Svetlik, Balingen (DE); Holger Klingler, Haigerloch (DE); Andrej Fahnenstiel, Balingen (DE); Jens Schmon, Messkirch-Langenhart (DE)

(73) Assignee: BIZERBA SE & CO. KG, Balingen (DE)

( * ) Notice: Subject to any disclaimer, the term of this patent is extended or adjusted under 35 U.S.C. 154(b) by 120 days.

(21) Appl. No.: 16/124,219

(22) Filed: Sep. 7, 2018

(65) Prior Publication Data

US 2019/0077037 A1 Mar. 14, 2019

(30) Foreign Application Priority Data

Sep. 14, 2017 (EP) ..... 17 191 144

(51) Int. Cl.
*B26D 5/20* (2006.01)
*B26D 7/06* (2006.01)
(Continued)

(52) U.S. Cl.
CPC ..... *B26D 5/20* (2013.01); *B26D 1/14* (2013.01); *B26D 5/00* (2013.01); *B26D 7/0616* (2013.01);
(Continued)

(58) Field of Classification Search
CPC ..... B26D 7/0616; B26D 7/0625; B26D 7/32; B26D 5/00; B26D 5/20; B26D 1/14
See application file for complete search history.

(56) References Cited

U.S. PATENT DOCUMENTS

2003/0200848 A1* 10/2003 Kuchler ..... B26D 5/34 83/13
2013/0319196 A1 12/2013 Schmeiser

FOREIGN PATENT DOCUMENTS

DE 202005007206 U1 7/2005
DE 202005021692 U1 4/2009
(Continued)

*Primary Examiner* — Kenneth E Peterson
*Assistant Examiner* — Nhat Chieu Q Do
(74) *Attorney, Agent, or Firm* — Leydig, Voit & Mayer Ltd.

(57) ABSTRACT

A method for operating a slicing machine for cutting slices of product from a strand-shaped product to be cut, preferably food, having a cutting device comprising a circular blade that rotates on a cutting plane about an axis of rotation and is driven by an electric circular blade motor, having a carriage that carries a support plate for placing the product to be sliced and can be displaced at a carriage speed $v_s$ parallel to the cutting plane, and having a chain of a chain frame that is driven by an electric chain frame motor for transporting away cut slices of product at a transport speed $v_T$ and for depositing them on a receiving table or a conveyor belt, with a number n≥2 of strands of product to be sliced being placed parallel to one another on the support plate with their strand axes aligned.

6 Claims, 4 Drawing Sheets

(51) Int. Cl.
*B26D 1/14* (2006.01)
*B26D 7/32* (2006.01)
*B26D 5/00* (2006.01)

(52) U.S. Cl.
CPC ..... *B26D 7/0625* (2013.01); *B26D 7/32* (2013.01); *B26D 2210/02* (2013.01)

(56) References Cited

FOREIGN PATENT DOCUMENTS

| | | | | | |
|---|---|---|---|---|---|
| EP | 2522474 | A1 | * | 11/2012 | ..... B26D 7/32 |
| EP | 2522474 | B1 | | 11/2012 | |
| EP | 2599598 | A2 | | 6/2013 | |
| EP | 2842703 | A1 | | 3/2015 | |

* cited by examiner

METHOD FOR OPERATING A SLICING MACHINE, AND SLICING MACHINE FOR SPACED STORAGE OF SLICES OF PRODUCT

CROSS-REFERENCE TO PRIOR APPLICATION

Priority is claimed to European Patent Application No. 17 191 144.9, filed on Sep. 14, 2017, the entire disclosure of which is hereby incorporated by reference herein.

FIELD

The invention relates to a method for operating a slicing machine for cutting slices of product from a strand-shaped product to be cut, preferably food, having a cutting device comprising a circular blade that rotates on a cutting plane about an axis of rotation and is driven by an electric circular blade motor, having a carriage that carries a support plate for placing the product to be sliced and can be displaced at a carriage speed $v_s$ parallel to the cutting plane, and having a chain of a chain frame that is driven by an electric chain frame motor for transporting away cut slices of product at a transport speed $v_T$ and for depositing them on a receiving table or a conveyor belt, with a number n≥2 of strands of product to be sliced being placed parallel to one another on the support plate with their strand axes aligned in the direction of the cutting plane before commencement of the slicing operation, so that a number of n slices of product are cut from the n strands of product to be sliced in one carriage stroke.

BACKGROUND

A slicing machine for such a method is known, for example, from EP 2 522 474 B1.

The product to be sliced in electrically driven slicing machines for strand-shaped foods such as sausages, ham, salmon, cheese, etc. is moved against the cutting device, usually in an x direction perpendicular to the cutting plane on which a rotating circular blade revolves. The conveyed product to be sliced is cut by the circular blade into slices.

It is possible and quite common to place two, three, or more strands of product to be sliced, such as sausage or cheese strands, for example, side by side on the support plate of the carriage. It is thus possible for a plurality of product slices to be cut with a single carriage stroke, whereby the effective cutting performance of the slicing machine is increased many times over.

The product slices are placed successively onto the tray or conveyor belt by means of the chain frame, particularly a depositing device of the chain frame.

Particularly if the slices are to be further processed, such as when wrapping asparagus spears with ham slices or when filling rolled sausage slices with cream cheese, the slices must always be spaced slightly apart from one another.

If different types of sliced products are cut, then it is also desirable for the slices of product to be placed in unmixed, spaced rows of slices.

When sliced products are placed into thermoformed packages as well, for example, it is desirable to stack a plurality of product slices in spaced stacks before they are transported away for packaging.

Therefore, spacing devices for the strands of product to be sliced are already known from the prior art that allow the product slices to be deposited in a plurality of rows of slices next to each other and with adjustable spacing between the slices.

EP 02 522 474 B1 cited at the outset discloses a line-spreading device of relatively complex construction that is arranged in the vicinity of the receiving table or conveyor belt and spreads the distance between two slices of product that are placed next to one another. However, such a solution requires a lot of space and often only leads to unsatisfactory results. For example, it is unavoidable in the case of rectangular product slices for laterally transported product slices to twist out of their desired target position.

If a spacing device is to be provided on the carriage, problems arise with space, among other things, which severely limits the number of strands of product that can be sliced simultaneously and/or the width of the strands of product that can be cut.

Another drawback of the known solutions is that setting the spacer devices to the desired slice spacing oftentimes involves very time-consuming work and/or only a very narrow adjustment range is made available for the slice spacing.

Methods for cutting strands of product to be sliced with the aim of producing a plurality of spaced-apart rows of sliced product in which slicing machines of the above-described known type are used have thus also only led to correspondingly unsatisfactory results.

SUMMARY

In an embodiment, the present invention provides a method for operating a slicing machine for cutting slices of product from a strand-shaped product to be cut, preferably food, having a cutting device comprising a circular blade that rotates on a cutting plane about an axis of rotation and is driven by an electric circular blade motor, having a carriage that carries a support plate for placing the product to be sliced and can be displaced at a carriage speed vs parallel to the cutting plane, and having a chain of a chain frame that is driven by an electric chain frame motor for transporting away cut slices of product at a transport speed $v_T$ and for depositing them on a receiving table or a conveyor belt, with a number n≥2 of strands of product to be sliced being placed parallel to one another on the support plate with their strand axes aligned in a direction of the cutting plane before commencement of the slicing operation, so that a number of n slices of product are cut from the n strands of product to be sliced in one carriage stroke, the method comprising: providing the instantaneous carriage speed $v_s(t)$ of the carriage as a specifiably controllable function of the time t that is decreased after each complete cutting of a single slice of product from the corresponding strand of product to be sliced during a subsequent time interval of duration Δt to the instantaneous carriage speed $v_s(t)=v_s-\Delta v_s$; and/or providing the instantaneous transport speed $v_T(t)$ of the chain frame as a specifiably controllable function of the time t that is increased after each complete cutting of a single slice of product from the corresponding strand of product to be sliced during a subsequent time interval of duration Δt to the instantaneous transport speed $v_T(t)=v_T+\Delta v_T$; and once each time interval of duration Δt has elapsed, again increasing the instantaneous carriage speed $v_s(t)$ of the carriage to $v_s(t)=v_s$ and/or again increasing the instantaneous transport speed $v_T(t)$ of the chain frame to $v_T(t)=v_T$.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
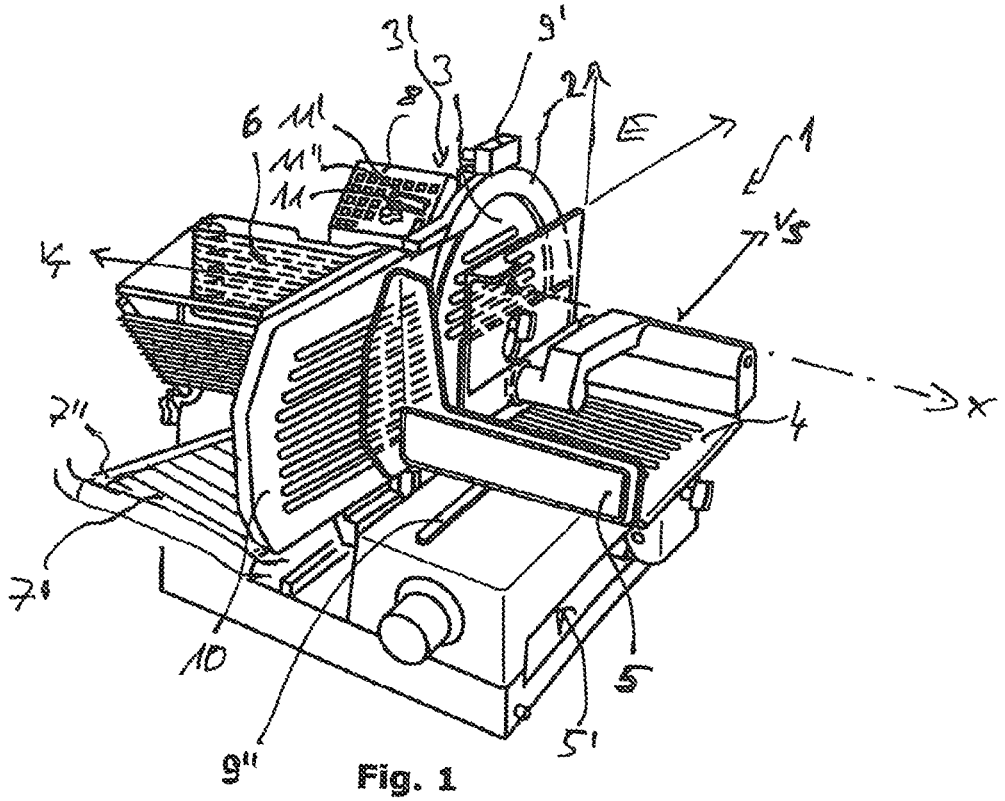
FIG. 1 is a schematic representation of a slicing machine according to the invention in a perspective view obliquely from above.

In view of this, it is the object of the present invention to provide a method of the generic type defined at the outset and a corresponding slicing machine inexpensively and with readily available technical means. The intention is to make it possible, particularly in a reproducible, reliable, and especially simple manner, to place slices of product such that they are spaced apart from one another with defined slice spacing.

This object is achieved by especially simple technical means and in a surprisingly effective manner by a method of this generic type which is wherein

- the instantaneous carriage speed $v_s(t)$ of the carriage is a specifiably controllable function of the time t that is decreased after each complete cutting of a single slice of product from the corresponding strand of product to be sliced during a subsequent time interval of duration $\Delta t$ to the instantaneous carriage speed $v_s(t)=v_s-\Delta v_s$; and/or
- that the instantaneous transport speed $v_T(t)$ of the chain frame is a specifiably controllable function of the time t that is increased after each complete cutting of a single slice of product from the corresponding strand of product to be sliced during a subsequent time interval of duration $\Delta t$ to the instantaneous transport speed $v_T(t)=v_T+\Delta v_T$;
- and that, once each time interval of duration $\Delta t$ has elapsed, the instantaneous carriage speed of the carriage is again increased to $v_s(t)=v_s$ and/or the instantaneous transport speed of the chain frame is again decreased to $v_T(t)=v_T$.

Particularly depending on the choice of the above alternatives, $\Delta t \cdot v_T$ can correspond to the desired lateral spacing between two adjacent cut slices of product on the chain of the chain frame.

The invention is based on the insight—which, in retrospect, seems obvious but had never been consistently exploited—that, by varying the instantaneous carriage speed $v_s(t)$ and/or by varying the instantaneous transport speed $v_T(t)$ of the chain frame, cut slices of product can be placed in different positions on the chain and/or subsequently on the receiving table or the conveyor belt. The slice spacing can thus be adjusted by varying each of these parameters to a desired level.

It should be noted that, in practice, the carriage and the chain of the chain frame have a certain inertia—the carriage due to its mass and the chain of the chain frame due to the construction of the drive. As a result, even in the prior art, the carriage speed and the transport speed of the chain frame are functions of time, since the carriage and the chain are respectively accelerated and decelerated. In the prior art, however, the carriage speed $v_s(t)$ and the transport speed $v_T(t)$ of the chain frame are synchronized. The present invention specifically eliminates this synchronization of the carriage speed $v_s(t)$ and the transport speed $v_T(t)$ of the chain frame that is desired and deemed necessary in the prior art.

The desired result—slices of product that are spaced apart from one another with predefinable slice spacing—can thus be achieved in a particularly simple and cost-effective manner without the need for a separate spacing device through especially ingenious controlling of the slicing machine.

In particular, neither spacing device nor complicated spreaders or the like are needed. The space on the support plate of the carriage that is intended for the placement of product to be sliced is already completely available for the product to be sliced. It is possible to switch without any difficulty between various types of sliced product, particularly with differently shaped strands of product to be sliced, since all of the necessary settings are electronically controllable.

With the method according to the invention, it is possible for only the instantaneous carriage speed $v_s(t)$ to be varied, or for only the instantaneous transport speed $v_T(t)$ to be varied, or for both the instantaneous carriage speed $v_s(t)$ and the instantaneous transport speed $v_T(t)$ to be varied.

The instantaneous transport speed $v_T(t)$ can be varied, particularly adjusted, by accelerating or decelerating the chain frame motor.

The slicing machine can also have a separate carriage motor for driving the carriage. The instantaneous carriage speed $v_s(t)$ can then be varied, particularly adjusted, by accelerating or decelerating the carriage motor.

To adjust the slice spacing, it is also possible for at least one thickness of a strand of product to be sliced to be taken into account in the selection of the speed levels $\Delta v_s$, $\Delta v_T$ and/or the time period $\Delta t$.

The method according to the invention can be used independently of the shape of the strands of product to be sliced. In particular, the method can also be successfully used for non-cylindrical strands of product to be sliced.

In particular, the method can comprise the following steps:

(a) placing a number $n \geq 2$ of strands of product to be sliced parallel to each other on the support plate in an initial operating position with their strand axes aligned in the direction of the cutting plane;

(b) bringing the chain frame to an instantaneous transport speed $v_T(t)=v_T$;

(c) accelerating the carriage parallel to the cutting plane to an instantaneous carriage speed $v_s(t)=v_s$ and cutting the first slice of the first strand of product to be sliced;

(d) as soon as the first slice of the first strand of product to be sliced has been completely cut:
  - decreasing the instantaneous carriage speed to $v_s(t)=v_s-\Delta v_s$ and/or
  - increasing the instantaneous transport speed of the chain frame to $v_T(t)=v_T+\Delta v_T$ for the duration of a time interval $\Delta t$;

(e) once the time interval $\Delta t$ has elapsed:
  - accelerating the carriage to the instantaneous carriage speed $v_s(t)=v_s$ and/or decreasing the instantaneous transport speed of the chain frame to $v_T(t)=v_T$;

(f) repeating steps (d) and (e) for the remaining $n-1$ strands of product to be sliced;

(g) returning the carriage to its initial operating position; and (h) repeating steps (c) to (g) until a desired number of slices of product have been made for all n strands of product to be sliced.

It is thus possible, particularly on the receiving table, for spaced-apart stacks of slices or, preferably on the conveyor belt, for spaced-apart rows of slices to be produced with the desired number of cut slices in each respective row of slices.

Using a current-measuring device, the present current consumption of the electric circular blade motor can be measured continuously. If a level of power consumption that is typical for a slicing operation is undershot, or if a predefined limit current value is reached, step (d) can then be initiated automatically for the respective strand of product to be sliced.

This approach is based on the fact known from our own investigations that, particularly at constant or essentially constant supply voltage, the power consumption of the (electric) circular blade motor depends on the present length of the instantaneous cutting line on the circular blade. The cutting line, in turn, can be used as an indicator of the instantaneous cutting position within a strand of product to be sliced. For example, it can be expected that, in the case of a cylindrical strand of product to be sliced, the power consumption initially increases up to the middle of the strand (cutting line becomes longer) and then drops again to a minimum (cutting line becomes shorter). This minimum, a level of power consumption that is typical for a slicing operation, and/or the reaching of a predefined limit current value can thus be detected and used as an indicator to determine whether or when a strand of product to be sliced has been completely cut through and a slice has therefore been completely separated.

$\Delta v_s = v_s$ can be selected as the speed level $\Delta v_s$, with the instantaneous carriage speed $v_s$ being decreased to zero for the duration of each time interval $\Delta t$, and with the instantaneous carriage speed $v_s(t)$ being increased back to $v_s(t)=v_s$ after the time interval $\Delta t$ has elapsed. It can thus be provided that the carriage stands still or "waits" for a moment at the boundary between two strands of product to be sliced before the cutting operation is continued. During the waiting time, the chain frame can continue to be moved, thereby producing, in turn, the desired slice spacing.

Slice spacing that is constant for all rows of slices can be achieved if the time period $\Delta t$ is selected so as to be less than the time required to completely cut a slice of product from the smallest-diameter strand of product to be sliced.

The carriage and the chain frame can be automatically controlled by the slicing machine if, immediately prior to or after placement of the n strands of product to be sliced onto the support plate, the number n, the width of the strands of product to be sliced, and the desired distance between the successively cut product slices on the chain frame are sent to a control device, which calculates from this the beginning and the end of each time interval of duration $\Delta t$, the required reduced instantaneous carriage speed $v_s(t)=v_s-\Delta v_s$ and, if necessary, the required increased instantaneous transport speed $v_T(t)=v_T+\Delta v_T$ of the chain frame and controls the respective moving parts of the slicing machine accordingly.

Intuitive and rapid inputting of the data required for the control is made possible by entering the number n and the width of strands of product to be sliced by moving manually to the respective strand position relative to the cutting edge of the circular blade at the respective initial positions of the n strands of product to be sliced for the cutting operation to be performed and by transmitting the respective positions reached to the control device.

For example, if three strands of product to be sliced lie side by side on the support plate of the carriage, the beginning of the first strand of product to be sliced can be recorded by moving manually to the first initial position. By moving to the initial position of the second strand of product to be sliced, the initial position of the second strand of product to be sliced and the end position of the first strand of product to be sliced can be recorded. By moving to the initial position of the third strand of product to be sliced, the initial position of the third strand of product to be sliced and the end position of the second strand of product to be sliced can be recorded. It can be taken into account that the third strand of product to be sliced can rest against a wall of the carriage, so the end position of the third strand of product to be sliced can be known from the outset. It is therefore not necessary to move specifically to that.

The scope of the invention also includes a slicing machine for carrying out the method according to the invention, having a cutting device that comprises a circular blade rotating on a cutting plane about an axis of rotation, having a carriage that carries a support plate for placing the product to be sliced and can be displaced at a carriage speed $v_s$ parallel to the cutting plane E, and having a chain frame that is driven by means of an electric chain frame motor for transporting away cut slices of product at a transport speed $v_T$ and for depositing them on a receiving table or a conveyor belt, with a control device being provided that controls the start and the end of each time interval of duration $\Delta t$, the instantaneous carriage speed $v_s$, and the instantaneous transport speed $v_T$ of the chain frame. The method according to the invention can be carried out without any difficulty on such a slicing machine. It thus allows cut slices of product to be placed with predefinable, desired lateral spacing.

In particular, the control device can be embodied such that it allows for at least the following method steps:

(b) bringing the chain frame to an instantaneous transport speed $v_T(t)=v_T$ after placement of a number $n \geq 2$ of strands of product to be sliced;

(c) accelerating the carriage parallel to the cutting plane to an instantaneous carriage speed $v_s(t)=v_s$ and cutting the first slice of the first strand of product to be sliced;

(d) as soon as the first slice of the first strand of product to be sliced has been completely cut:

reducing the instantaneous carriage speed to $v_s(t)=v_s-\Delta v_s$ and/or increasing the instantaneous transport speed of the chain frame to $v_T(t)=v_T+\Delta v_T$ for the duration of a time interval $\Delta t$;

(e) upon lapsing of the time interval $\Delta t$:

accelerating the carriage to the instantaneous carriage speed $v_s(t)=v_s$ and/or decreasing the instantaneous transport speed of the chain frame to $v_T(t)=v_T$;

(f) repeating steps (d) and (e) for the remaining n−1 strands of product to be sliced;

(g) returning the carriage to its initial operating position; and (h) repeating steps (c) to (g) until a desired number of slices of product have been made for all n strands of product to be sliced.

For this purpose, the control device can be embodied as an arithmetic and logic unit or have an arithmetic and logic unit on which a computer program product is executably stored.

A provision can be made that the slicing machine has a sensor device for detecting the current carriage position relative to the axis of rotation of the rotating circular blade and/or for detecting the current cutting state of the last strand of product to be sliced that came into contact with the circular blade. In particular, the sensor device can be connected to the control device so as to enable data exchange. This allows the current carriage position to be determined. The cutting state can be used to determine the point in time at which an end of a strand of product to be sliced is reached. The instantaneous carriage speed $v_s(t)$ and/or the instantaneous transport speed $v_T(t)$ can thus be controlled on the basis of the measurement data of the sensor device.

As cost-effective, readily available, and precisely operating sensors, the sensor device can comprise an incremental rotary encoder and/or an absolute displacement transducer sensor and/or a magnetic field sensor, preferably a Hall sensor.

An especially reliable sensor system can be achieved if the sensor device comprises a mechanical, particularly an electromechanical switch that is preferably embodied as a roller switch or as a contact switch.

The thickness of the cut product slices can be adjusted if a stop plate that is arranged parallel to the cutting plane and can be displaced in an x direction, particularly along the axis of rotation, is provided for the purpose of adjusting the slice thickness.

Preferably, the slicing machine can be embodied as a vertical slicer.

The data required for the depositing of the slices can be entered with particular ease if the slicing machine according to the invention comprises an operating terminal at which the operator can enter the number n, the width of the products to be sliced, and the mutual spacing thereof, preferably using a guided operator menu. In view of hygiene requirements that usually exist for slicing machines, the operating terminal can, in particular, be a touch display unit and is preferably washable and/or disinfectable. If the slicing machine is set up to automatically determine the width of the products to be cut, the operating terminal can also be set up such that the operator only inputs the number n and the desired spacing.

In any case, in order to speed up and simplify the inputs, it is also conceivable for typical datasets—such as a standard number, a standard width and/or standard spacing and/or combinations of these datasets, for example—to be available for selection at the operating terminal. In particular, it is conceivable that a default setting assumes that all of the strands of product to be sliced have the same thickness and/or that different thicknesses of the strands of product to be sliced are provided only if these different thicknesses are explicitly inputted by the operator.

Additional features and advantages of the invention follow from the detailed description of an embodiment of the invention below that is provided with reference to the drawings, which show details that are essential to the invention, and from the claims.

The individual features can each be implemented individually or in any combination in variants of the invention.

To facilitate understanding of the invention, respective analogous elements of the slicing machine according to the invention and of the steps of the method according to the invention are designated in the following by the same reference numerals in all of the drawings insofar as possible.

FIG. 1 is a perspective representation of an electrically operated slicing machine 1 having a cutting device 2 that is embodied as a vertical slicer. The slicing machine 1 comprises a circular blade 3 that rotates on a cutting plane E about an axis of rotation X. The circular blade is driven by a circular blade motor 3' (see also FIG. 2). Furthermore, the slicing machine 1 has a carriage 5 that carries a support plate 4 for placing the product to be sliced and can be displaced at a carriage speed $v_s$ parallel to the cutting plane E, and a chain frame 6 that is driven by means of a chain frame motor 6' for transporting away cut slices of product at a transport speed $v_T$ and for depositing them on a conveyor belt 7' or a receiving table 7".

For purposes of illustration, only a portion of the conveyor belt 7' and receiving table 7" is shown. If no transport of cut product slices by the conveyor belt 7' is desired, only the receiving table 7", without the conveyor belt 7', can also be embodied on the slicing machine 1. If no conveyor belt 7' is used, the receiving table 7" can preferably have a flat receiving surface for cut product slices.

The chain frame 6 has a chain that circulates at the transport speed $v_T$ on which the cut product slices can be transported to their storage location. The chain is driven by the chain frame motor 6', so that the transport speed $v_T$ can also be controlled or adjusted by controlling the chain frame motor 6'.

The carriage 5 is driven by a carriage motor 5'. By controlling the carriage motor 5', the carriage speed $v_s$ can thus be controlled.

The slicing machine 1 further comprises a control device 8 that is embodied as a computer unit and on which a computer program product is executably stored in a memory unit of the computer unit. The computer program product is set up to control or implement the method according to the invention that is described in greater detail below (see in particular the description of FIG. 10). For this purpose, the control device 8 is electrically connected particularly to the carriage motor 5' and the chain frame motor 6'.

The slicing machine 1 can further comprise a sensor device 9 having two sensor components 9' and 9". The sensor component 9' is embodied as a current-measuring device and measures the present current consumption of the circular blade motor 3'. A current cutting state of a strand of product to be sliced that last came into contact with the circular blade 3 is detected based on the present current consumption. For this purpose, the points in time at which the current consumption falls below a predetermined limit value and the points in time at which this current consumption exceeds the limit value (possibly again) are detected by the sensor component 9'. The sensor component 9" comprises a displacement transducer sensor with which it identifies or detects the current carriage position of the carriage 5 relative to the axis of rotation X of the rotating circular blade 3. Each sensor component further comprises a contact switch that is positioned at one end of the carriage path of the carriage 5 and is set up to signal the reaching of an absolute starting or end position of the carriage 5.

Moreover, the slicing machine 1 has a stop plate 10 with which the thickness of the slices of product to be cut can be adjusted. For this purpose, the stop plate 10 is arranged parallel to the cutting plane E and can be displaced or adjusted in the x direction, i.e., parallel to the axis of rotation X.

The slicing machine 1, particularly the control device 8, also has an operating terminal 11 having a keypad 11' and a display unit 11". The operating terminal 11 is used to input and transmit the information required for a cutting operation to the control device 8. In particular, an operator can enter the number n, the width(s) of products to be cut, particularly strands of product to be sliced, and a desired lateral distance by which the product slices are to be spaced apart from one another when deposited. For this purpose, the user is supported by an operator menu that is displayed on the display unit 11".

The functionality and operation of the slicing machine 1 and the method according to the invention for operating the slicing machine 1 will now be explained in greater detail below with reference to FIGS. 2 to 10.

For this purpose, the following FIGS. 2, 3, 5, 7 and 9 are highly schematic representations of the slicing machine 1 in a plan view in different phases of the method according to the invention.

Figure 4:
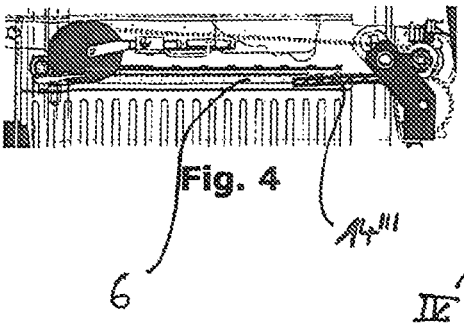
FIGS. 3 to 9 are schematic representations of the slicing machine according to the invention and a detailed view of the chain frame in different phases of the slice-cutting, each as plan views from above.
Figure 3:
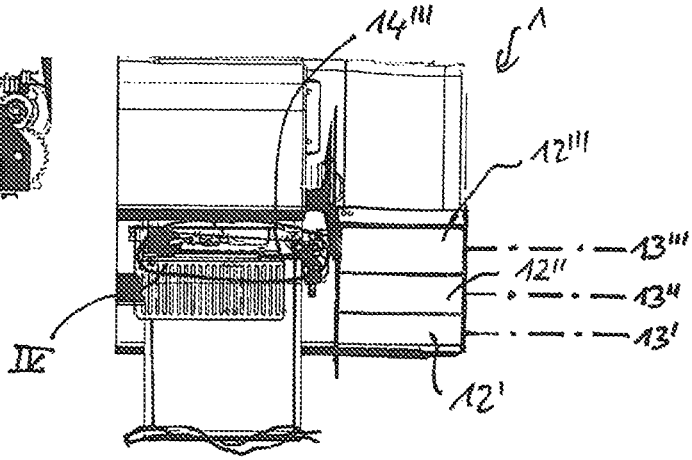
Figure 6:
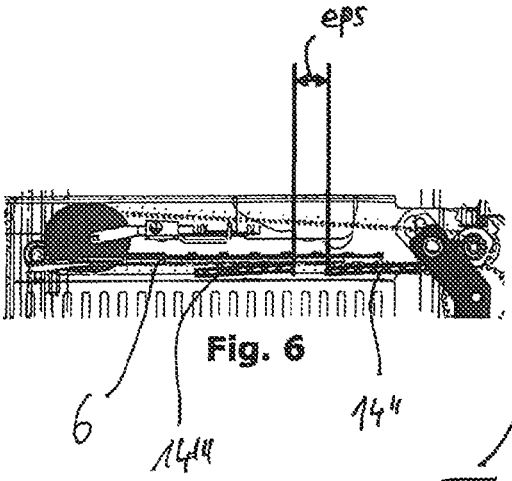
Figure 5:
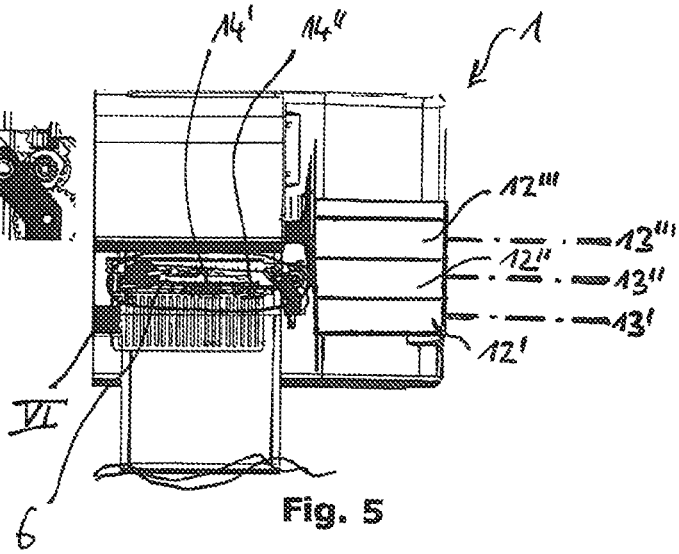
Figure 8:
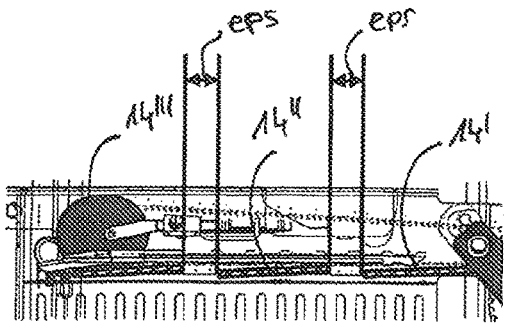
Figure 7:
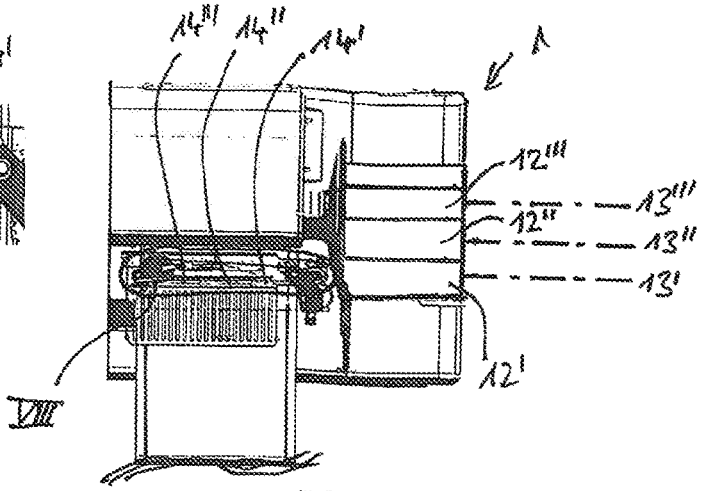

In addition, FIG. 4, 6, 8 are likewise highly schematic representations of detailed views, particularly of the chain frame 6, in the respective phases corresponding to FIGS. 3, 5 and 7. In particular, FIG. 4 shows cut-out IV of FIG. 3; FIG. 6 shows cut-out VI of FIG. 5; and FIG. 8 shows cut-out VII of FIG. 8.

Figure 10:
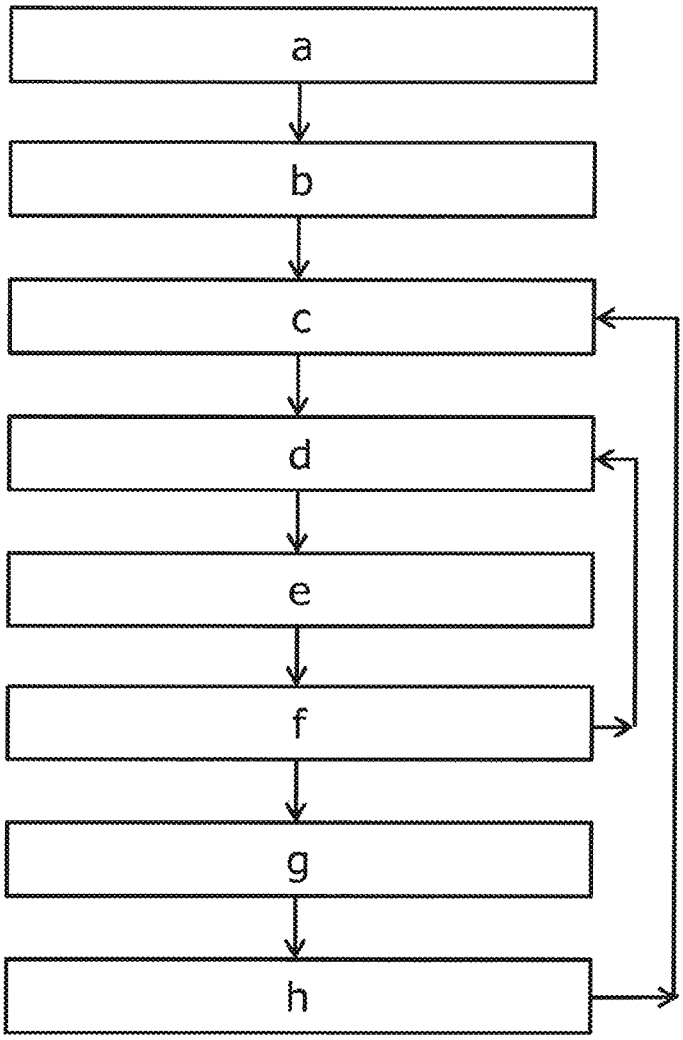
FIG. 10 is a schematic flowchart of the method according to the invention.

FIG. 10 is a flowchart of the method according to the invention with the method steps a to h defined above.

Figure 2:
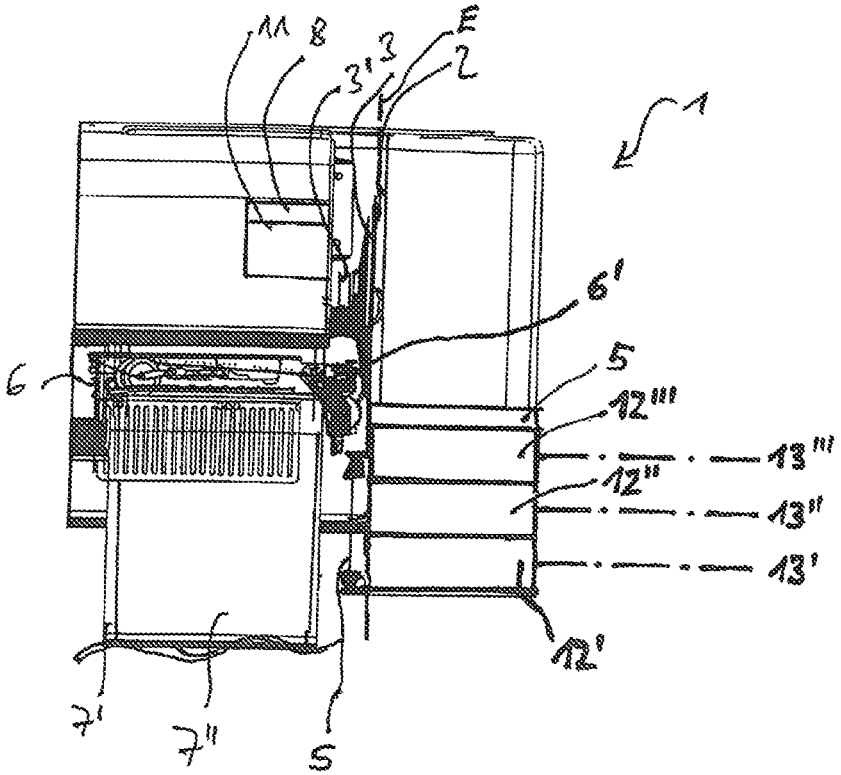
FIG. 2 is a schematic representation of the slicing machine of FIG. 1 in a basic position in a plan view from above.

In a first method step a (FIG. 10), as can be seen in FIG. 2, a number n of at least 2, in the illustrated example three, strands of product to be sliced 12', 12" and 12'" with their strand axes 13', 13" and 13'" that are aligned in the direction of the cutting plane E are placed parallel to each other on the support plate 4 in an initial operating position.

Now, slices of product are to be cut from these strands of product to be sliced 12', 12" and 12'" by means of the cutting device 2, particularly the circular blade 3 that is driven by the circular blade motor 3', and placed with a desired lateral spacing on the chain frame 6 and subsequently on the support table 7' or conveyor belt 7". At the same time, For this purpose, the carriage 5 must be moved by a maximum carriage stroke s, which follows from the total width of the strands of product to be sliced 12', 12" and 12'".

In the context of method step a, immediately prior to or after placement of the n=3 strands of product to be sliced 12', 12" and 12'" onto the support plate 4, an operator inputs the number n, the widths of the strands of product to be sliced 12', 12" and 12'", and the desired lateral spacing between the successively cut product slices on the chain frame 6 at the operating terminal 11, which transmits these data to the control device 8. As will be explained in greater detail later, the control device calculates the data required for the spacing of the product slices and controls the relevant moving parts of the slicing machine 1 accordingly.

While in this variant the widths are inputted manually and the maximum carriage stroke s calculated from the sum, another variant of the method according to the invention makes a provision that the operator moves the carriage respectively according to the lateral beginning or end of a strand of product to be sliced 12', 12" or 12'" relative to a cutting edge of the circular blade 3 and stops the movement for a short time. By means of the sensor device 9, the control device 8 then detects the stoppage and, on the basis of the respective measured position of the carriage, determines the width of the respective strand of product to be sliced 12', 12" or 12'" to which the carriage has been moved, thus rendering the manual inputting thereof unnecessary. The maximum carriage stroke s is thus also determined from the first initial position and the last end position that is reached.

In a subsequent method step b (FIG. 10), the control device 8 drives the chain frame motor 6' and thus the chain frame 6 at a standard preset transport speed $v_T$, so that it is moved at an instantaneous transport speed $v_T(t)=v_T$. The circular blade 3 is set in motion.

In a method step c (FIG. 10), the carriage 5 is accelerated by means of the carriage motor 5' parallel to the cutting plane E to an instantaneous carriage speed $v_s(t)=v_s$, with $v_s$ also corresponding to a standard preset speed.

As can be seen in FIG. 3 and in the detailed view according to FIG. 4, a first slice 14'" is cut from the strand of product to be sliced 12'", whereas the other two strands of product to be sliced 12" and 12' are still uncut.

In particular, it can be seen from FIG. 4 that the cut slice 14'" reaches the chain frame 6.

As soon as the first slice 14'" of the first strand of product to be sliced 12'" has been completely cut off, the carriage 5 is briefly stopped in a subsequent method step d (FIG. 10). In other words, the instantaneous carriage speed $v_s(t)$ of the carriage 5 is reduced for a short time interval Δt to $v_s(t)=v_s-\Delta v_s=0$, where $v_s=\Delta v_s$.

In this variant of the method, the time interval Δt is selected so as to be shorter than the time required for the complete cutting of a slice from the strand of product to be sliced 12', 12" or 12'" having the smallest cross section. This required time interval Δt is calculated by the control device 8 as a function of—and, in this variant of the method, particularly as a quotient of—the desired lateral spacing and the transport speed $v_T$.

While the carriage 5 is stopped, the chain frame continues to travel at the transport speed $v_T$, so that the slice 14' located thereon continues to be transported overall by the desired lateral distance.

Once the time interval Δt has elapsed, the instantaneous carriage speed $v_s(t)$ of the carriage 5 is again increased to its original carriage speed $v_s(t)=v_s$ in a method step e (FIG. 10).

As indicated in FIG. 10 by a dotted line, method steps d and e are repeated according to method step f (FIG. 10) for the remaining n−1 slices 12" and 12'".

In this regard, FIGS. 5 and 6 show the state of the slicing machine 1 after a slice 14" has been cut from the strand of product to be sliced 12" at the moment the carriage 5 is starting again in order to cut the last strand of product to be sliced 12'.

It can be seen, particularly from FIG. 6, that the cut product slices 14'" and 14" are transported such that they are spaced apart from one another on the chain frame 6 by a defined distance eps. The distance eps corresponds to the desired lateral spacing preset by the operator.

FIGS. 7 and 8 show the state of the slicing machine 1 after a last slice 14' has been cut from the strand of product to be sliced 12' at the moment the carriage 5 is starting again in order to cut the last strand of product to be sliced 12'.

It can be seen, particularly from FIG. 8, that the cut product slices 14', 14" and 14'" are each transported such that they are spaced apart from one another on the chain frame 6 by the distance eps.

Figure 9:
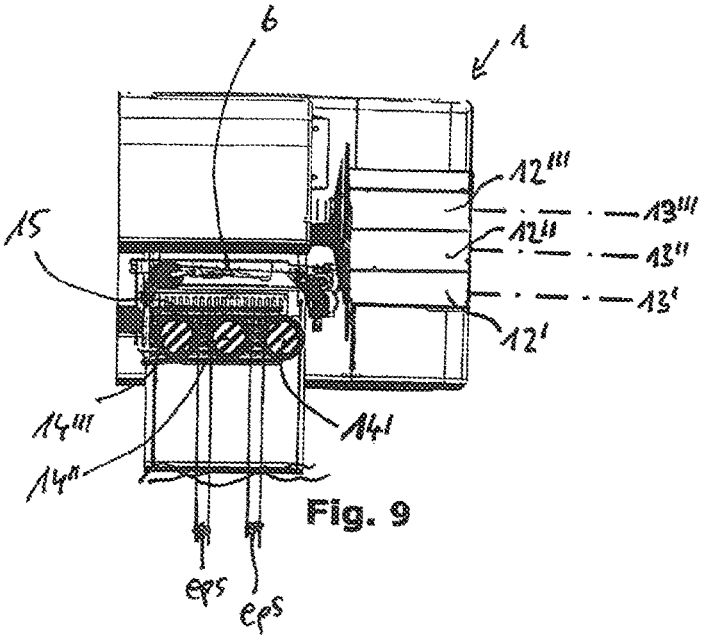

FIG. 9 shows a subsequent phase in which the product slices 14', 14" and 14'" have been delivered by means of a take-off 15 from the chain frame 6 to the conveyor belt 7'. It is clearly visible that the product slices 14', 14" and 14'" have been deposited on the conveyor belt 7' so as to be spaced apart from each other by a lateral distance eps as desired by the operator.

Subsequently, in a method step g (FIG. 10), the carriage 5 is returned to its initial operating position according to FIG. 1.

Method steps c to g are repeated according to method step h (FIG. 10) until a desired number of cut product slices 14', 14" and 14'" has been reached for all n strands of product to be sliced 12', 12" and 12'". In an alternative variant, these steps are repeated until all strands of product to be sliced 12', 12" and 12'" have been completely cut.

After completion of the cutting operation, the control device 8 stops the chain frame 6, the circular blade 3, and the carriage 5 by means of these respective associated motors.

All of the cut and now spaced-apart product slices 14', 14" and 14'" can now be transported away from the slicing machine 1 by means of the conveyor belt 7' and/or packaged.

A variant of the method according to the invention makes a provision that—particularly in the case of narrow strands of product to be sliced 12', 12" and 12'" and/or depending on the position of the cutting edge of the circular blade—the carriage 5 is not moved over the entire maximum carriage stroke s, but rather only far enough—e.g. 80% of the maximum carriage stroke s—that all of the product slices 14', 14" and 14'" have been completely cut. A provision can also be made that the operator additionally sets the desired carriage stroke s.

Accordingly, a carriage zero position of the carriage 5, in which product to be sliced is put into position, can be differentiated from the initial position for the cutting operation, in which first strand of product to be sliced 12'" contacts the circular blade 3.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SIGNS

1 slicing machine
2 cutting device
3 circular blade
3' circular blade motor
4 support plate
5 carriage
5' carriage motor
6 chain frame
6' chain frame motor
7' conveyor belt
∂" receiving table
8 control device
9 sensor device
9', 9" sensor component
10 stop plate
11 operating terminal
11' display unit
11" keypad
12', 12", 12'" strand of product to be sliced
13', 13", 13'" strand axis
14', 14", 14'" slice of product
15 take-off
a to h method step
eps distance
IV, VI, VII cut-out
E cutting plane
s maximum carriage stroke
$v_s$ carriage speed
$v_T$ transport speed

What is claimed is:

1. A method for operating a slicing machine for cutting slices from a product to be sliced, wherein the slicing machine comprises:

a cutting device comprising a circular blade that rotates on a cutting plane about an axis of rotation and is driven by an electric circular blade motor;

a carriage that carries a support plate for placing the product to be sliced, and that can be displaced at a carriage speed $v_s$, parallel to the cutting plane; and a chain of a chain frame that is driven by an electric chain frame motor for transporting away the cut slices of the product at a transport speed $v_T$, and that is for depositing the cut slices on a receiving table or a conveyor belt, wherein a number $n \geq 2$ of strands of the product to be sliced are placed parallel to one another on the support plate with their strand axes aligned in a direction of the cutting plane before commencement of the slicing operation, so that a number of n slices of product are cut from then strands of the product to be sliced in one carriage stroke, the method comprising:

providing an instantaneous carriage speed $v_s(t)$ of the carriage as a specifiably controllable function of a time t, the instantaneous carriage speed being decreased, by a carriage speed change amount $\Delta v_s$, after each complete cutting of a single slice of the product from the corresponding strand of the product to be sliced during a subsequent time interval of duration $\Delta t$ to a required reduced instantaneous carriage speed $v_s(t)=v_s-\Delta v_s$; and once the time interval of duration $\Delta t$ has elapsed, increasing the instantaneous carriage speed $v_s(t)$ of the carriage back to the carriage speed $v_s(t)=v_s$, or the method comprising:

providing an instantaneous transport speed $v_T(t)$ of the chain frame as a specifiably controllable function of the time t, the instantaneous transport speed being increased, by a transport speed change amount $\Delta v_T$, after each complete cutting of a single slice of the product from the corresponding strand of the product to be sliced during the subsequent time interval of duration $\Delta t$ to a required increased instantaneous transport speed $v_T(t)=v_T+\Delta v_T$; and once the time interval of duration $\Delta t$ has elapsed, decreasing the instantaneous transport speed $v_T(t)$ of the chain frame back to $v_T(t)=v_T$, and wherein the method further comprises:

immediately prior to or after placement of the n strands of the product to be sliced onto the support plate, sending information comprising: the number n, a width of the strands of the product to be sliced, and a desired distance between the successively cut slices on the chain frame to a control device, wherein the control device:

calculates from the sent information: a beginning and an end of each time interval of duration $\Delta t$, the required reduced instantaneous carriage speed $v_s(t)=v_s-\Delta v_s$ of the carriage or the required increased instantaneous transport speed $v_T(t)=v_T+\Delta v_T$ of the chain frame; and controls the respective carriage or the chain frame of the slicing machine accordingly.

2. The method as set forth in claim 1, comprising at least the following steps:

(a) placing the number $n\geq 2$ of the strands of the product to be sliced parallel to each other on the support plate in an initial operating position with their strand axes aligned in the direction of the cutting plane;

(b) bringing the chain frame to the instantaneous transport speed $v_T(t)=v_T$;

(c) accelerating the carriage parallel to the cutting plane to the instantaneous carriage speed $v_s(t)=v_s$ and cutting a first slice of a first strand of the product to be sliced;

(d) as soon as the first slice of the first strand of the product to be sliced has been completely cut: decreasing the instantaneous carriage speed $v_s(t)$ to the required reduced instantaneous carriage speed $v_s(t)=v_s-\Delta v_s$ or increasing the instantaneous transport speed $v_T(t)$ of the chain frame to the required increased instantaneous transport speed $v_T(t)=v_T+\Delta v_T$ for the duration of the time interval $\Delta t$;

(e) once the time interval $\Delta t$ has elapsed: accelerating the carriage to the instantaneous carriage speed $v_s(t)=v_s$ and/or decreasing the instantaneous transport speed $v_T(t)$ of the chain frame to $v_T(t)=v_T$;

repeating steps (d) and (e) for the remaining n−1 strands of the product to be sliced;

(g) returning the carriage to its initial operating position; and (h) repeating steps (c) to (g) until a desired number of slices of the product have been made for all the n strands of the product to be sliced.

3. The method as set forth in claim 2, wherein, using a current-measuring device, a present current consumption of the electric circular blade motor is measured continuously, and wherein, based upon determining that a level of power consumption that is typical for a slicing operation is undershot, or based upon determining that a predefined limit current value is reached, the step (d) is initiated automatically for the respective strand of the product to be sliced.

4. The method as set forth in claim 1, wherein the carriage speed change amout $\Delta v_s=v_s$ is selected, with the instantaneous carriage speed $v_s(t)$ being decreased to zero for the duration of the time interval $\Delta t$, and that the instantaneous carriage speed $v_s(t)$ is increased back to $v_s(t)=v_s$ after the time interval $\Delta t$ has elapsed.

5. The method as set forth in claim 1, wherein the time period $\Delta t$ is selected so as to be less than a time required to completely cut a slice of the product from a smallest-diameter strand of the product to be sliced.

6. The method as set forth in claim 1, the method comprising determining the number n and the width of the strands of product to be sliced by moving the carriage manually to a respective strand position relative to the cutting edge of the circular blade at the respective initial positions of the n strands of product to be sliced for the cutting operation to be performed and by transmitting the respective positions reached to the control device.

* * * * *